US012721460B2

(12) United States Patent
Samuel

(10) Patent No.: US 12,721,460 B2
(45) Date of Patent: Sep. 1, 2026

(54) VOLUME ADJUSTABLE LIMITED FLOW DRINKING CUP

(71) Applicant: NORTH COAST MEDICAL INC., Morgan Hill, CA (US)

(72) Inventor: Stephen M. Samuel, San Jose, CA (US)

(73) Assignee: NORTH COAST MEDICAL INC.

( * ) Notice: Subject to any disclaimer, the term of this patent is extended or adjusted under 35 U.S.C. 154(b) by 0 days.

(21) Appl. No.: 19/286,140

(22) Filed: Jul. 30, 2025

(65) Prior Publication Data

US 2026/0033652 A1 Feb. 5, 2026

Related U.S. Application Data

(60) Provisional application No. 63/677,133, filed on Jul. 30, 2024.

(51) Int. Cl.
*A47G 19/22* (2006.01)

(52) U.S. Cl.
CPC ..... *A47G 19/2272* (2013.01)

(58) Field of Classification Search
CPC ..... B65D 25/04; A47G 19/2266; A47G 19/2272; G01F 11/26; G01F 11/262
USPC ..... 220/703, 710.5, 711
See application file for complete search history.

(56) References Cited

U.S. PATENT DOCUMENTS 4,614,285 A * 9/1986 Fudalla ..... G01F 11/262 222/455
4,921,112 A * 5/1990 Juhlin ..... A61J 9/00 215/11.4
6,755,318 B2 * 6/2004 Burke ..... G01F 11/262 220/759
12,150,572 B2 * 11/2024 Hodges ..... A47G 19/2272
2014/0069885 A1 * 3/2014 Paxson ..... A61J 9/006 215/11.4
2020/0039738 A1 * 2/2020 Duman ..... A47J 31/0615

* cited by examiner

*Primary Examiner* — Luan K Bui
(74) *Attorney, Agent, or Firm* — Joseph R. Englander, Esq.; Lewis Brisbois Bisgaard & Smith LLP

(57) ABSTRACT

A limited pour cup for dispensing a variable volume of liquid has a base cup and an inner cup disposed within and spaced from the base cup, forming a reservoir. An opening in the inner cup is in fluid communication with the reservoir. A plunger is rotatably disposed within the inner cup. A chamber in fluid communication with the reservoir is formed by a wall of the plunger, a wall of the inner cup and the opening. The plunger wall may change positions relative to the fixed wall, changing the chamber's volume. A spout is formed on a lid. A straw extends from the chamber through the plunger. A plunger seal and lid form a fluid pathway from the straw to the spout. The spout is located away from the opening in the inner cup so when the cup is raised, the opening is positioned above the spout.

13 Claims, 6 Drawing Sheets

VOLUME ADJUSTABLE LIMITED FLOW DRINKING CUP

CROSS-REFERENCE TO PRIOR APPLICATION

This application claims priority of Provisional Application Ser. No. 63/677,133 filed Jul. 30, 2024.

BACKGROUND OF THE INVENTION

The present invention is directed to a structure for a limited pour, or sippy, cup, and more particularly, a limited pour drinking cup in which the volume of flow is adjustable.

Many patients have difficulty swallowing food and drink. They may suffer from dysphagia causing cognitive and motor issues as a result of stroke, head injury, neurological disorders, or even aging. As a result of dysphagia, patients may suffer from dehydration and nutritional defects.

When patients suffering from Dysphagia attempt to swallow liquids, the bolus may tend to go down the bronchus and into the lungs, causing coughing, choking and even aspiration which may lead to pneumonia. To avoid dehydration, these patients are often given fluids in very small volumes. These are provided by limited flow drinking cups.

Limited flow drinking cups such as those known from US Patent Published Application No. 2022/0400880 are known in the art to provide fluids in small doses. This limited flow cup includes an outer cup. An inner cup, disposed within the outer cup, contains the fluid. When attached to each other the inner cup and outer cup provide fluid transfer reservoir extending to a mouthpiece vent hole. A conduit prevents the user from drawing excess fluid out of a reservoir. However, this cup suffers from a disadvantage, that at a minimum it can only deliver dosages of a single size.

Accordingly, a structure which overcomes the shortcomings of the prior art is provided.

SUMMARY OF THE INVENTION

A limited pour cup for dispensing a predetermined volume of liquid to a user each time the limited pour cup is tilted to a drinking position has a base cup. An inner cup is disposed within and spaced from the base cup. A reservoir is formed between the base cup and the inner cup to contain a supply of liquid. An opening in the inner cup is in fluid communication with the reservoir. A plunger is rotatably disposed within the inner cup. A chamber, in fluid communication with the reservoir, is formed by a wall of the plunger, a wall of the inner cup and the opening. Rotation of the plunger causes the plunger wall to move between a first position and a second position relative to the fixed wall, changing the volume of the chamber. A spout is formed on the lid. A straw extends from the chamber through the plunger to convey liquid from the chamber through the plunger. The plunger seal and lid form a fluid pathway from the straw to the spout. The spout is disposed at a position away from the opening in the inner cup such that when the cup is raised to a drinking position the opening is positioned above the spout.

In one embodiment of the invention removable handles are provided to facilitate use by patients of varying physical abilities.

In another embodiment, a dial is disposed on the lid, and coupled to the plunger for rotating the plunger between at least the first position and the second position.

BRIEF DESCRIPTION OF THE DRAWINGS

The present disclosure will be better understood by reading the written description with reference to the accompanying drawing figures in which like reference numerals denote similar structure and refer to like elements throughout in which.

DETAILED DESCRIPTION OF THE PREFERRED EMBODIMENTS

Figure 1:
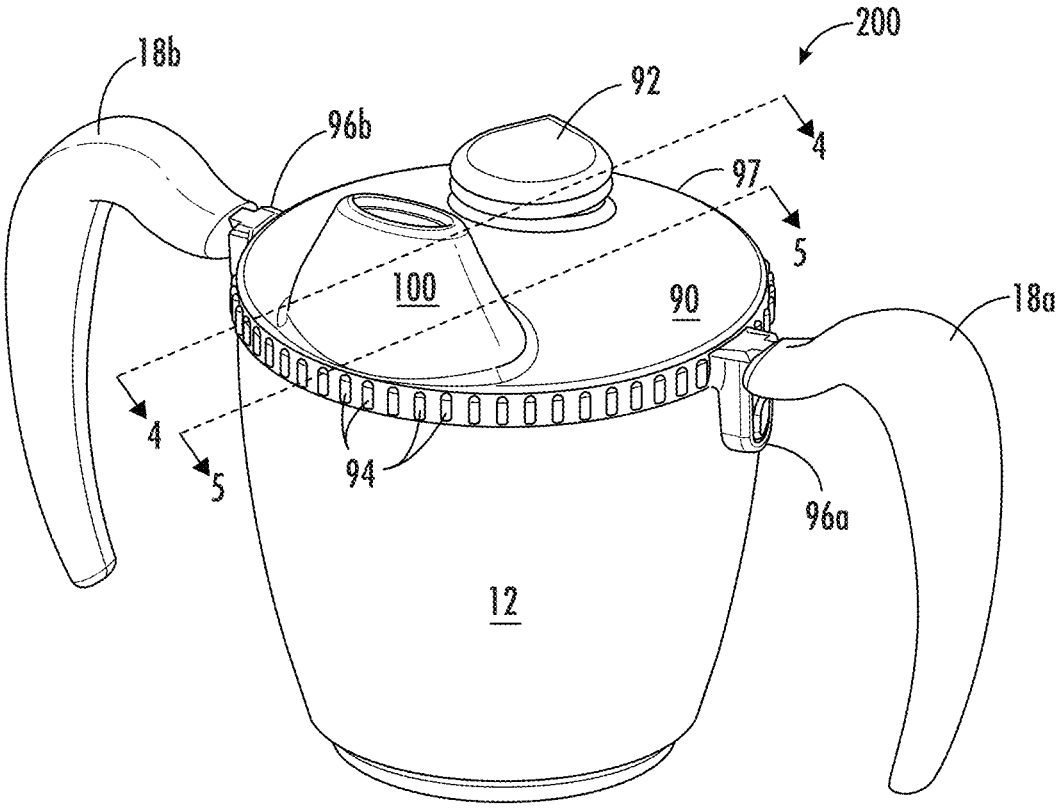
FIG. 1 is perspective view of a cup constructed in accordance with the invention.
Figure 2:
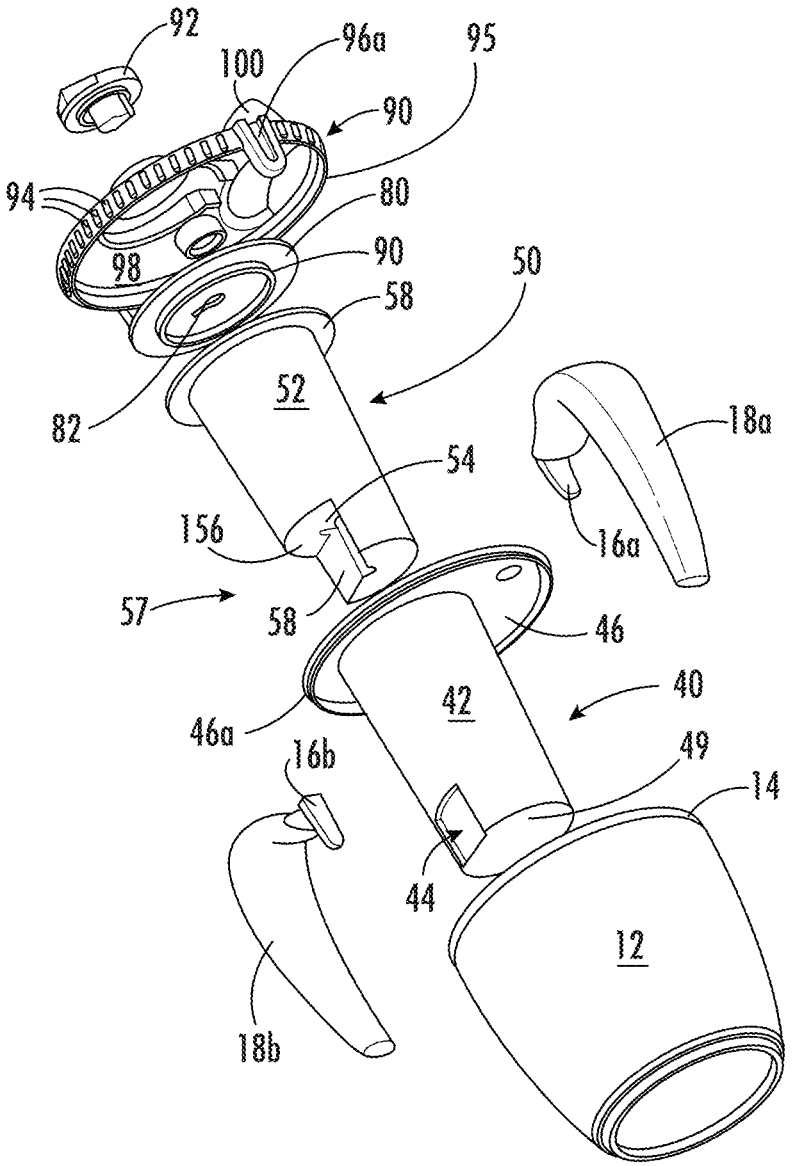
FIG. 2 is a perspective exploded view of a cup constructed in accordance with the invention.
Figure 3:
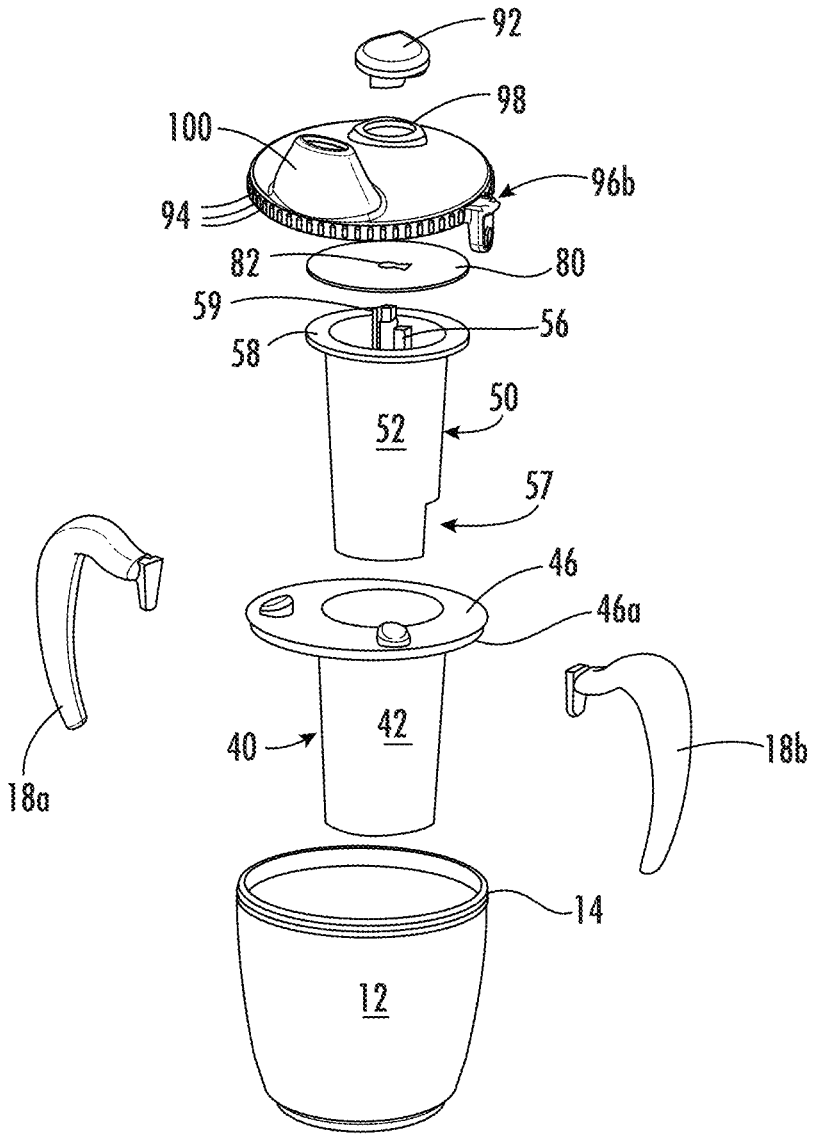
FIG. 3 is a perspective exploded view of a cup constructed in accordance with the invention.

Reference is first made to FIG. 1-3 in which a cup, generally indicated as 200, for metering small doses of a liquid during use, is provided. Cup 200 includes a base or outer cup 12. Outer cup 12 may be constructed of any suitable material capable of containing a liquid, preferably a hard plastic or lightweight metal for containing a liquid.

As more particularly seen in FIGS. 2 and 3, cup 200 includes an inner cup 40 disposed within base cup 12. A plunger 50 is rotatably mounted within inner cup 40. A plunger seal 80 is disposed on plunger 50 and a lid 90 engages and seals base cup 12. Base cup 12 includes a sealing structure 14 such as threads, in one non limiting example, which engage corresponding sealing structure such as threads 95 of lid 90.

Lid 90 includes a spout 100 in liquid communication with the interior of cup 200. A plurality of ribs 94 are disposed about a circumference of lid 90 to facilitate gripping of lid 90 during removal and attachment. A volume selection dial 92, described in greater detail below, is rotatably disposed within an opening 98 on lid 90, spaced apart from spout 100. Indicia 97, corresponding to amount of liquid to be dispensed as a function of the position of dial 92, is provided on lid 90.

As shown in FIG. 1, the cup includes selectively releasable handles. Flanges 96*a*, 96*b* are disposed on opposed sides of lid 90 and handles 18*a*, 18*b* include a respective dovetail 16*a*, 16*b* which are selectively releasably received therein. By having releasable handles 18*a*, 18*b*, cup 200 may be used with two handles, one handle, or no handles depending on the physical capabilities of the patient. Additionally, the flanges, and in turn the handles are disposed substantially midway about the circumference of lid 90 from spout 100. Other structures for selectively releasable handles known in the art are also contemplated.

Figure 4:
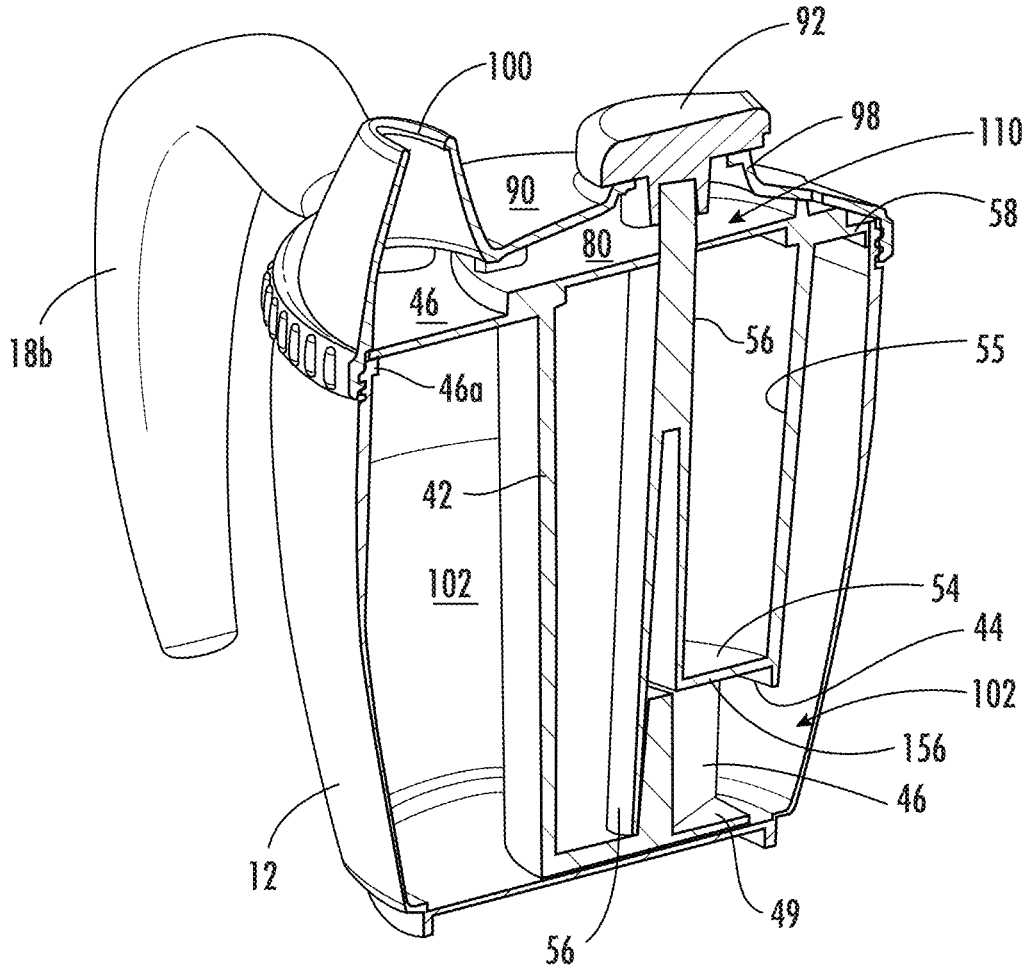
FIG. 4 is a sectional view taken along line 4-4 of FIG. 1.

Inner cup 40 includes a hollow inner cup base 42. As shown in FIG. 2, a window 44 is formed in the inner cup base 42 to communicate with an interior of the inner cup base 42. An inner cup lid 46 extends from inner cup base 42 to have a diameter substantially that of the outer cup 12, such that inner cup lid 46 rests on the outer cup 12 when cup 200 is assembled. Inner cup lid 46 extends to a rim or lip 46*a* which, when cup 200 is assembled, is engaged between outer cup 12 and lid 90 to maintain inner cup 40 in a fixed position. The diameter of the inner cup base 42 is less than the diameter of base cup 12, so that a reservoir 102, as shown in FIG. 4, is formed between inner cup 40 and base cup 12 when assembled.

Figure 7:
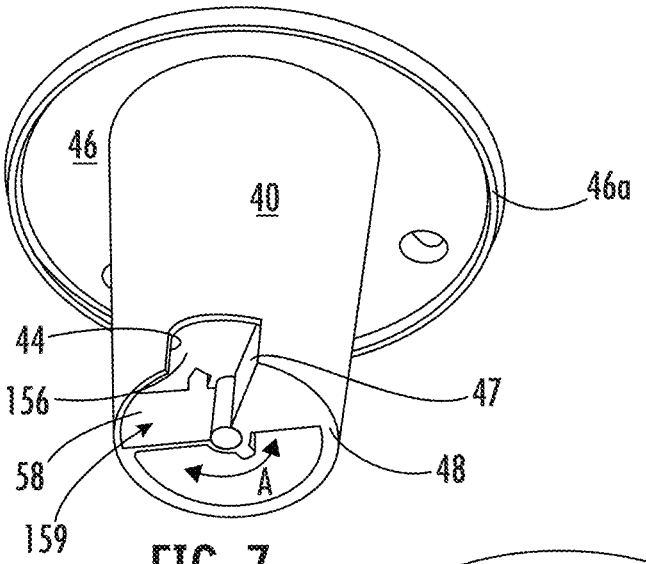
FIG. 7 is a perspective view of the plunger and inner cup forming a chamber of a first volume in accordance with the invention.
Figure 8:
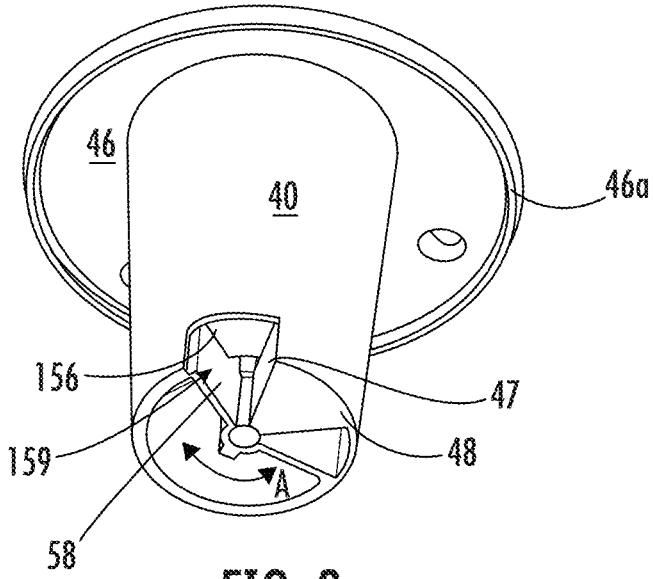
FIG. 8 is a perspective view of the plunger and inner cup forming a chamber of a first volume in accordance with the invention.

Inner cup 40 is formed with a window 44 therein. As shown in FIGS. 7 and 8, an inner wall 47 of inner cup 40 disposed within window 44 extends at least the height of window 44. In a preferred non limiting embodiment, the wall 47 is a surface of a wedge 48 formed within the inner cup 40.

Plunger 50 is rotatable disposed within inner cup 40. Plunger 50 includes a plunger base 52 having a hollow interior and a plunger rim 58. Plunger base 52 is substantially flush with an interior surface of inner cup base 42. Plunger rim 58 is slidably disposed on inner lid 46. Plunger 50 is rotatable between a first position and a second position relative to inner cup 40. To facilitate rotation, inner cup 40 may include a pivot received by plunger 50 to facilitate rotation.

Plunger 50, in a preferred nonlimiting embodiment, has a stepped structure, forming a step 54 in an interior and exterior of plunger 50 at a position corresponding to the position of window 44 on the inner cup 40 when plunger 50 is rotated into a first position. Step structure 54 has the effect of forming a cut out 57 on an exterior surface of plunger 50. The cutout portion 57 includes a ceiling 156 and a trailing wall 58. As shown in FIGS. 7 and 8, ceiling 156 has a height sufficient to contact and slide along wedge 48, and wall 47. Trailing wall 58 extends from ceiling 156 to a floor 49 of inner cup 40.

The width of cut out portion 55 of the plunger 50 is greater than a width of window 44 in the inner cup 40. Cutout portion 57 forms a window facing chamber 159 between inner wall 47, ceiling 156 and a trailing wall 58. Chamber 159 is open at window 44. The volume within chamber 159 changes as plunger 50 is rotated to move trailing wall 58 either towards or away from fixed wall 47 in respective directions of arrow A. In a preferred embodiment, a chamber of 10 cc is formed at a first position of wall 58 (FIG. 7) and a chamber of 5 cc is formed at a second position of trailing wall 58 (FIG. 8).

Figure 5:
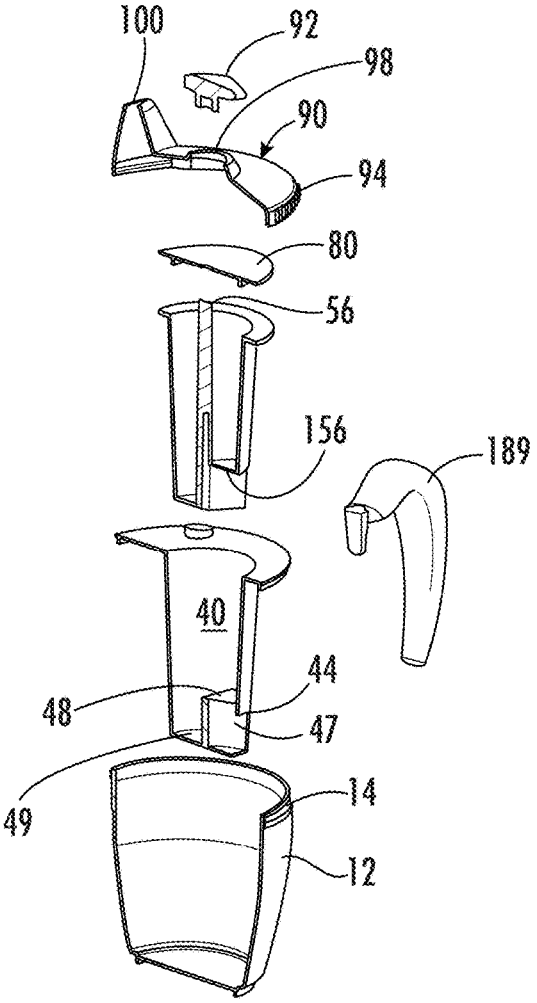
FIG. 5 is a sectional view taken along line 5-5 of FIG. 3.
Figure 6:
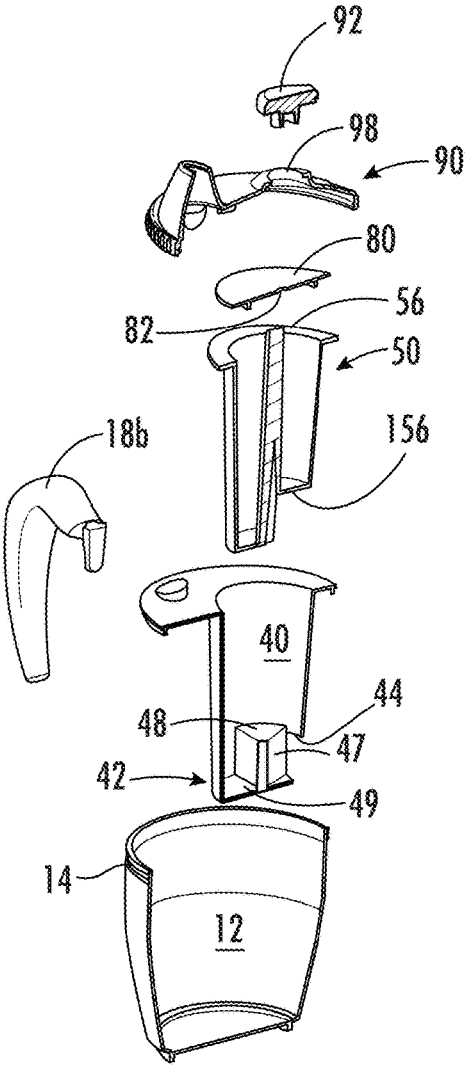
FIG. 6 is a sectional view taken along line 6-6 of FIG. 3.

As shown in FIGS. 4-6, a straw 56 is in fluid communication with chamber 159. Straw 56 extends from chamber 159 to beyond rim 58 to convey liquids beyond plunger 50. As shown in FIG. 3, a stem 59 is affixed to plunger 50, or formed as a unitary construction with the plunger 50 and extends at least to lid 90 where it is engaged by volume selection dial 92. In this configuration, as dial 92 is rotated within opening 98 stem 59, and in turn plunger 50 are rotated in either direction of arow A between the first position and the second position; changing the volume of chamber 159 in turn.

A plunger seal 80 is disposed on plunger 50 and seals plunger 50. Plunger seal 80 has an opening 82 therein for receiving straw 56 and stem 59 therethrough. In this embodiment opening 82 has a non-circular shape to better interlock with straw 56 and stem 59 and cause plunger 50 to rotate with rotation of the straw 56 stem 59 structure. However, other geometry for the opening is also considered.

When lid 90 is secured to base cup 12, at least stem 59 extends to engage dial 92 so that dial 92, stem 59, and plunger 50 rotate in unison. As shown in FIG. 4, a space 110 is formed between plunger seal 80 and lid 90. Straw 56 is in fluid communication with space 110. Space 110 is in fluid communication with spout 100 so that a flow path for a fluid is formed from the reservoir 102 formed by base cup 14, into chamber 155, through straw 56, into space 110 and through spout 100.

Inner cup 40 is anchored to base cup 12 by lid 90 as discussed above. Window 44 faces a side of base cup 12 which is oriented away from a side of base cup 12 at which spout 100 is positioned. Dial 92 is used to pivot plunger 50 to move trailing wall 58 to a desired position. In this way during use, as cup 12 is raised it is tilted upwards relative to spout 100. During this motion chamber 159 fills with liquid of the desired volume, as a function of the position of trailing wall 58, from reservoir 102. Liquid in chamber 159 is able to travel through the straw 56, into space 110 and through spout 100; metering liquid dosages. In one non-limiting embodiment, the plunger 50 may rotate into a position wherein the chamber 159 may close so that a predetermined volume of liquid may be sealed within the chamber.

In use, the cup 200 dispenses a predetermined volume of liquid to a user each time the limited pour cup is tilted to a drinking position.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

The invention claimed is:

1. A limited pour cup for dispensing a predetermined volume of liquid to a user each time the limited pour cup is tilted to a drinking position comprising:

a base cup;

an inner cup disposed within and spaced from the base cup;

a reservoir being formed between the base cup and the inner cup to contain a supply of liquid, a window, formed in the inner cup, in fluid communication with the reservoir, and a fixed wall, accessible from the window, disposed in the inner cup;

a plunger rotatably disposed within the inner cup, the plunger having a wall and being rotatable between a first position and second position;

a chamber, in fluid communication with the reservoir, formed by the wall of the plunger, the fixed wall of the inner cup and the window;

wherein a rotation of the plunger relative to the inner cup causes the plunger wall to move between a first position and a second position relative to the fixed wall;

wherein rotation of the plunger changes the volume of the chamber;

a straw disposed in the plunger and in fluid communication with the chamber;

a seal disposed on the plunger, the straw extending through the seal;

a lid disposed on the cup; and a spout formed on the lid;

wherein the inner cup, plunger, straw, seal and lid form a fluid pathway from the reservoir to the spout.

2. The cup of claim 1, wherein the spout is disposed at a position away from an opening in the inner cup such that when the cup is raised to a drinking position the opening is positioned above the spout.

3. The cup of claim 1, wherein the inner cup comprises an inner cup lid, wherein the inner cup lid has a diameter substantially that of the outer cup.

4. The cup of claim 3, wherein the plunger comprises a plunger seal, wherein the plunger seal engages and seals the base cup.

5. The cup of claim 4, wherein the plunger comprises a stepped structure forming a step in an interior and exterior of plunger at a position corresponding to a position of the window of the inner cup.

6. The cup of claim 1, wherein the lid further comprises a lid opening, and further comprising a volume selection dial disposed on the lid opening.

7. The cup of claim 1, wherein the inner wall of the inner cup is disposed within the window and extends for a height of the window.

8. The cup of claim 7, wherein the wall is a surface of a wedge formed within the inner cup.

9. The cup of claim 8, further comprising a plunger base on the plunger, wherein the plunger base is substantially flush with an interior surface of inner cup base.

10. The cup of claim 9, wherein a plunger rim is slidably disposed on the inner cup lid, and wherein the plunger is rotatable between a first position and a second position relative to the inner cup.

11. The cup of claim 1, wherein the lid comprises gripping structure.

12. The cup of claim 1, wherein the base cup and the lid further comprise complementary sealing structure.

13. The cup of claim 1, further comprising a plurality of selectively releasable handles located on the base cup.

* * * * *